US005201281A

United States Patent [19]

Cella

[11] Patent Number: 5,201,281

[45] Date of Patent: Apr. 13, 1993

[54] STEAM GENERATOR MAINTENANCE APPARATUS

[76] Inventor: Alexander Cella, Robinwood Dr., Great Notch, N.J. 07424

[21] Appl. No.: 848,741

[22] Filed: Mar. 10, 1992

[51] Int. Cl.[5] ..... F22B 37/54

[52] U.S. Cl. ..... 122/382; 122/379; 122/504; 134/167 R; 376/249

[58] Field of Search ..... 122/379, 381, 382, 391, 122/392; 376/249; 134/167

[56] References Cited

U.S. PATENT DOCUMENTS

| | | | |
|---|---|---|---|
| 4,394,217 | 6/1983 | Holz et al. | 202/227 |
| 4,424,769 | 1/1984 | Charamathieu et al. | 122/392 |
| 4,508,063 | 4/1985 | Monne | 122/504 |
| 4,603,661 | 8/1986 | Nelson et al. | 122/392 |
| 4,757,785 | 7/1988 | Klahn et al. | 122/382 |
| 4,827,953 | 5/1989 | Lee | 122/392 X |
| 5,036,871 | 8/1991 | Ruggieri | 134/167 R |
| 5,065,703 | 11/1991 | Lee | 122/382 |

*Primary Examiner*—Edward G. Favors
*Attorney, Agent, or Firm*—Bryan Cave

[57] ABSTRACT

A track and carriage combination for supporting maintenance equipment in pressurized water reactor steam generators is disclosed. A pair of outwardly extending grooves are machined into the annulus portion of the generator tubesheet. Geared segments are provided for being inserted in the grooves for forming a geared track upon which the maintenance device may be firmly supported. Each geared segment includes gear teeth, a base shaped to mate with and engage the annulus grooves. A keyway is provided at the tubelane for allowing the segments to be slidably inserted into the grooves. Each segment is slightly curved so as to form a track corresponding with the annulus curvature. The segments are interlockable so that the segments may be removed from the annulus without any segments being left inside the steam generator. If desired, the track may be of one-piece construction and permanently mounted in the annulus. Each segment includes shoulders for supporting and stabilizing the maintenance device in conjunction with support arms on the maintenance device. The track of the present invention is preferably for use with a support carriage mounted to the maintenance device. The support carriage is of suitable design for use with the track cross-section, having gears corresponding with the gear teeth on the track and support arms for grasping the track shoulders.

8 Claims, 9 Drawing Sheets

FIG. 7
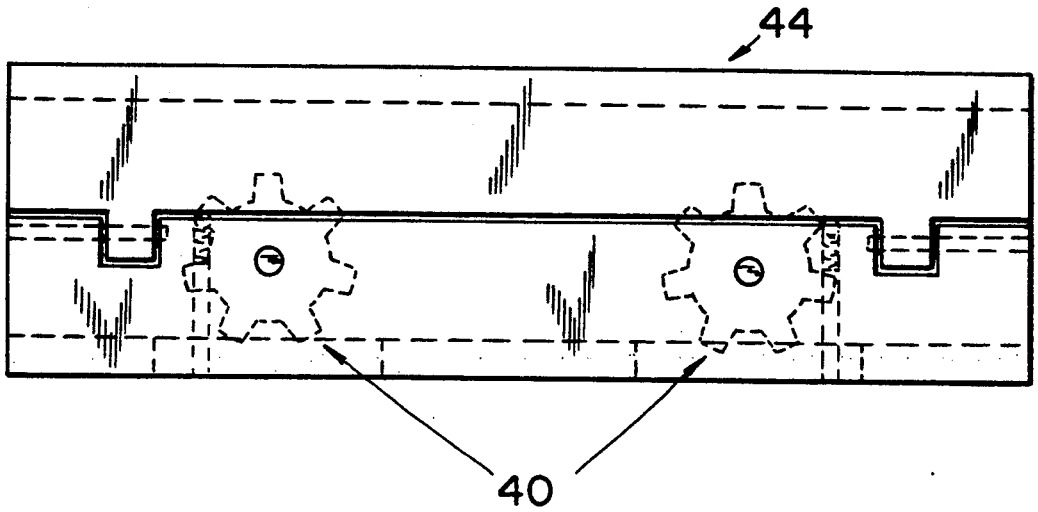
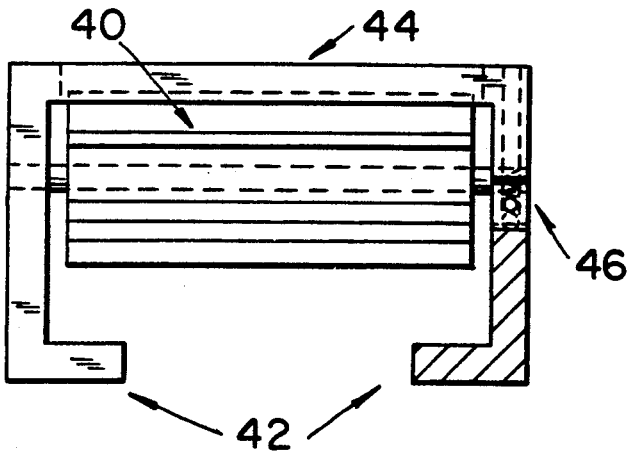
FIG. 8

STEAM GENERATOR MAINTENANCE APPARATUS

BACKGROUND OF THE INVENTION

1. Field of the Invention

The present invention relates generally to nuclear steam generator maintenance devices, and more particularly to a geared track installable in the annular space of a steam generator for providing a stable base for operating maintenance equipment.

2. Description of the Prior Art

Steam generators are used in nuclear power stations for heat exchange purposes in the generation of steam for driving turbines. A primary fluid, heated by the core of the reactor, is led through a bundle of U-type or once-through tubes in the steam generator. A secondary fluid, generally water, is fed into the space around the tubes and receives heat from the tubes to provide a continuous steam generation cycle. Due to the constant high temperature and severe operating environment of the steam generator, internal maintenance procedures are required for the generator. One of the most common procedures is the removal of sludge deposits from the lower tubesheet region. The sludge buildup on the tubesheet and tubes reduces the heat transfer efficiency of the tubes and can cause corrosion. Therefore, it is preferable that the tubes and tubesheet be periodically cleaned to remove the sludge.

Many steam generators have a square-pitch tube configuration which have well-defined channels between the tubes, as described hereinafter. These can be cleaned rather easily with a sludge lance apparatus from the tubelane between the semi-circular tube bundles. The lance is equipped with a series of discharge nozzles which spray streams of high pressure water at the area between the tubes to dislodge the sludge. This type of equipment is quite stable since it may be bolted directly to the steam generator frame.

For example, Lee, U.S. Pat. No. 5,065,703, discloses a system for lancing sludge deposits from within a bundle of square-pitch steam generator tubes. A flexible lance is moved down the tubelane and inserted in the intertube lanes for sludge removal using pressurized fluid.

Ruggieri, U.S. Pat. No. 5,036,871 discloses a similar flexible lance system operative from the tubelane. A support rail is provided along the tubelane for supporting and driving the lance.

Most recent generators having been replacing the square-pitch tube configuration with a triangular-pitch. This configuration enables the generator to contain more tubes per unit area, and thus increases heat transfer. However, the increased density of the tubes makes it more difficult to clean between the tubes. Other techniques have been developed to provide more effective lancing of these newer systems.

Klahn et al., U.S. Pat. No. 4,757,785, discloses a lance assembly for cleaning the tube areas of a once-through steam generator (OTSG) inaccessible from the tubelane. A track is assembled in the annular space between the OTSG outer shell and a circular shroud which surrounds the tube bundle. A remotely controlled movable lancing apparatus is driven along the track for cleaning the tubes through windows in the shroud.

Previous devices which attempted to clean the tubes from the annular space tend to be unstable. These devices are usually self-propelled, or cable driven, and are top-heavy. When the water pressure to the lance is turned on, the apparatus leans back due to the force of the water, and the streams of water cannot be adequately controlled or aimed between the triangular tubes where the sludge is located. The distance between the tubes is very small and the lance is difficult to align even under ideal circumstances, if the tubes were visible. But in this case, the tubes cannot be seen as they are located in inaccessible areas. To overcome this difficulty, it is possible to locate a camera in the tube lane, or near the lance. The camera quickly becomes covered by water and is of limited utility.

A further difficulty with previous systems is that they are limited to a single purpose, i.e. sludge lancing. None of the prior art is directed toward providing a generalized stable platform for a steam generator maintenance apparatus, i.e. tube repair, parts retrieval, etc. Furthermore, none of the prior systems provided a means for providing an accurate position determination around the steam generator without the use of extraneous optical equipment.

SUMMARY OF THE INVENTION

The present invention is a track and carriage combination for providing a stable base for maintenance equipment, such as a sludge lancing assembly, on the secondary side of pressurized water reactor ("PWR") steam generators. The system of the present invention is suitable for use with square-pitch or triangular-pitch tube bundles, and with once-through or U-type tubing.

A pair of grooves are machined into the annulus of the tubesheet located toward the bottom of the steam generator. Geared segments are provided for insertion in the grooves for forming a geared track upon which the maintenance device may be firmly supported. Each geared segment includes gear teeth for providing an accurate means for facilitating movement of the maintenance apparatus which is mountable thereon. The gear teeth are preferably located on the top side of the track, but may be positioned otherwise provided that they are accessible by the maintenance device riding on the track. The gears on the track preferably provide stability and accurate positioning even under large forces.

Each segment preferably includes a base having outwardly extending engaging members shaped to mate with and engage the grooves in the tubesheet annulus. These members have a sufficient tolerance to allow the segments to be firmly supported by the annulus, yet to be slidably insertable in the grooves. At the tubelane, a keyway is formed by machining away the upper lip of the inside groove for allowing the segments to be inserted into the outside groove, and slidably inserted into the inside groove. Once inserted in the grooves, the segments may be slidably moved around the annulus, but may not be removed except at the keyway region. If desired, rollers or wheels may be provided on the engaging members for allowing the segments to be more easily moved within grooves.

Each segment is preferably sized slightly smaller than the width of the keyway, which is approximately the same width as the tubelane. Each segment is preferably slightly curved so as to be easily insertable into the circular annulus and so that the track formed by the segments is circular.

The segments are preferably interlockable so that the segments may be removed from the annulus without any segments being left inside the steam generator, and to provide a more stable track. Each segment preferably includes a male interlocking member and a female interlocking member which fasten to each other. As the segments are inserted into the grooves at the keyway, the male interlocking member of each segment is engaged with the female interlocking member of the previously inserted segment. When all of the segments have been inserted, a continuous firmly supported circular geared track is present in the annular space. The segment located in the keyway region may be secured by conventional securing means. In an alternative embodiment, the track may be of one-piece construction and permanently mounted in, or to, the annulus.

The base of each segment is preferably connected to the gear section by an upright member and shoulders. The shoulders provide an attachment point for support arms on the undercarriage of the maintenance apparatus to be mounted on the track. The maintenance device may also include propulsion means, if desired, for driving a gearing means relative to the gears on the track.

The segments are preferably constructed of a non-corrosive material capable of operating in the hostile steam generator environment, such as stainless steel or thermoplastic. The segmented track may be left in the steam generator during operation, if desired.

The track of the present invention is preferably for use in conjunction with a support carriage mounted to a maintenance device for use in the steam generator. The maintenance device may be of any type, but the support carriage must be of a design suitable for use with the particular design of the track. The track may have many different cross-sections, having the gears mounted in different positions, having various shoulder configurations, and optionally being removable. The support carriage preferably includes a gear means for meshing with the gear teeth of the track and at least one support arm for grasping the support shoulders, these being compatible with the particular cross-section and gearing of the track installed in the annulus. Once mounted on the track, the carriage is able to move along the track, but may not be removed from the track without either releasing the support arms, or moving the maintenance device to an end of the track.

As noted, the support carriage may be attached to any desired maintenance device which may include self-propulsion means for driving the gears on the carriage device. This maintenance device may be, for example, sludge lancing equipment, robotic tube repairing equipment, a device for retrieving lost parts, an inspection camera, etc. Using the track and carriage combination of the present invention, these devices may be accurately positioned anywhere around the circumference of the steam generator, and are very stable for use with high power equipment.

The segmented track of the present invention permits precise movement of the maintenance equipment by the use of the geared track along which the apparatus can progress in small predetermined increments. The position of the apparatus can be accurately calculated, using, for example, an encoder. An infra red beam may also be used to conform alignment of the device.

According to the present invention tracks of different cross-sections may be interchanged depending upon the particular application, or as track designs improve.

BRIEF DESCRIPTION OF THE DRAWINGS

FIG. 7 shows a side view of a support carriage for supporting a maintenance device on the segmented track of the present invention.

FIG. 8 shows a front view of a support carriage for supporting a maintenance device on the segmented track of the present invention.

DESCRIPTION OF THE PREFERRED EMBODIMENT

Figure 1:
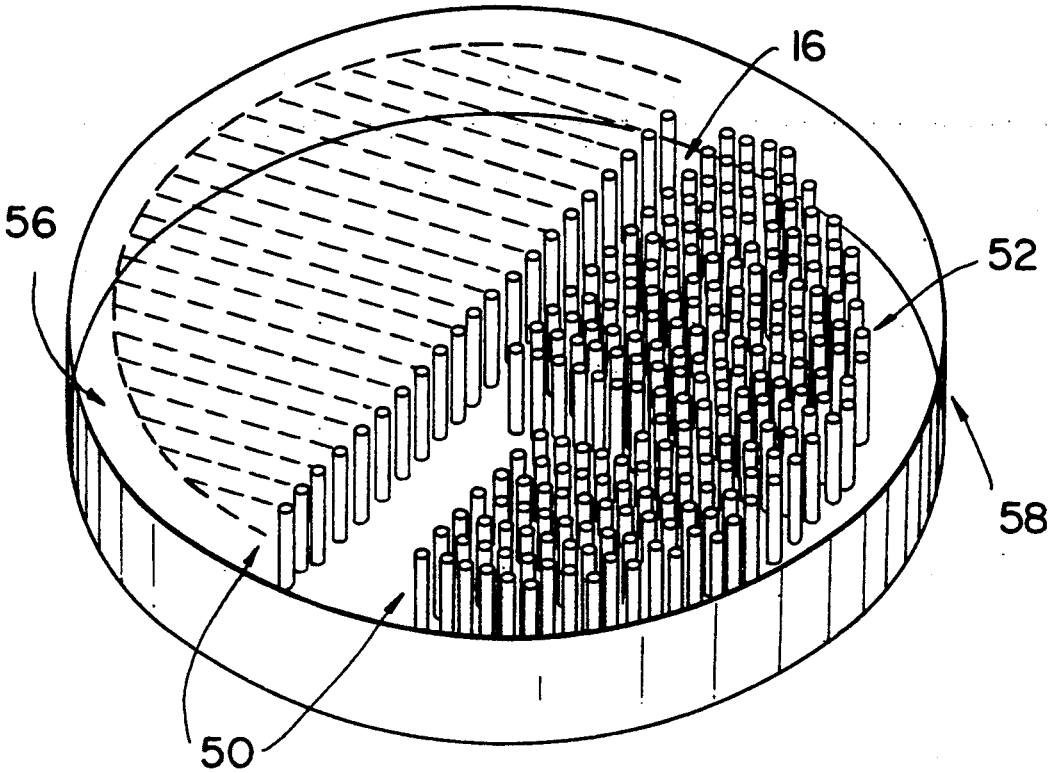
FIG. 1 PRIOR ART
FIG. 1 is a schematic perspective view illustrating the tube bundles of a typical nuclear steam generator.

The system of the present invention is a novel track and carriage combination to simplify maintenance on the secondary side of pressurized water reactor ("PWR") steam generators in the nuclear power industry. As shown in FIG. 1, a typical PWR steam generator secondary-side assembly comprises a pair of generally semicircular bundles 50 of vertically extending steam tubes 52 separated by a tubelane 16. An annular space 56 separates the tube bundles 50 from the steam generator walls 58.

Figure 2:
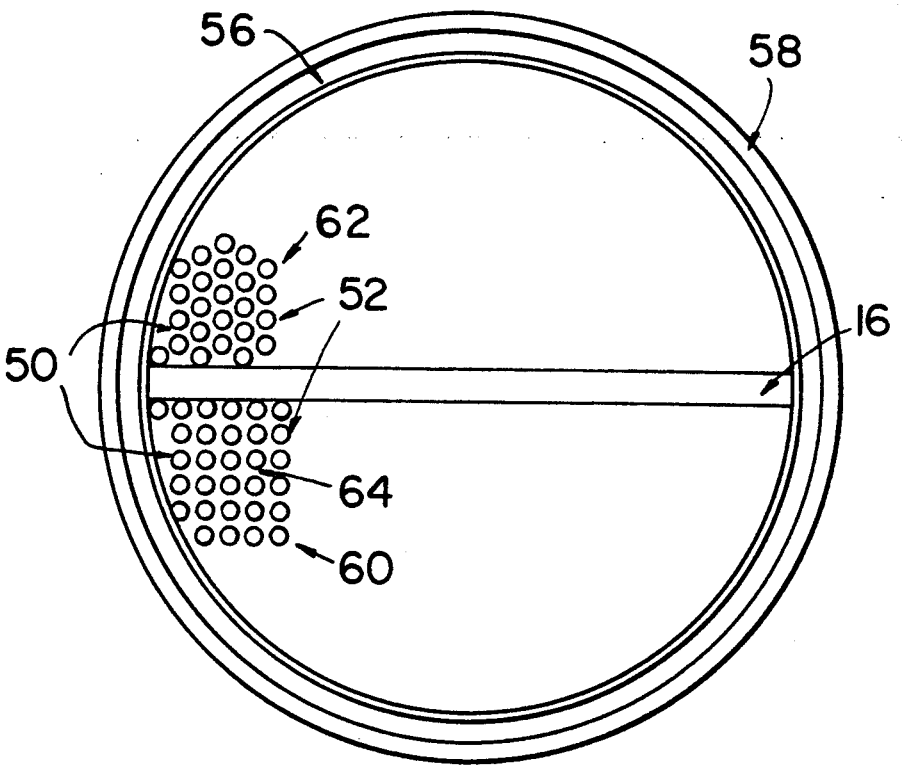
FIG. 2 PRIOR ART
FIG. 2 is a schematic top view illustrating the layout and tube configurations of a typical nuclear steam generator.

As shown in FIG. 2, the tubes 52 are generally organized in either a square-pitch configuration 60 or a triangular-pitch configuration 62. In the square pitch configuration 60, intertube channels 64 allow for access between the tubes 52 for maintenance, i.e. sludge removal or tube repairs. In order to provide more efficient transfer of heat between the primary and secondary generator systems most newer steam generators employ the triangular-pitch tube configuration 60 which provides increased tube density. As a consequence, the gaps between the tubes 52 are greatly reduced, and there are no well defined access channels 64 between the tubes 52. This configuration thus makes maintenance of the steam generator more difficult. For example, conventional sludge-lancing equipment located in the tube lane is no longer effective at dislodging sludge centrally located in the tube bundle.

Figure 3:
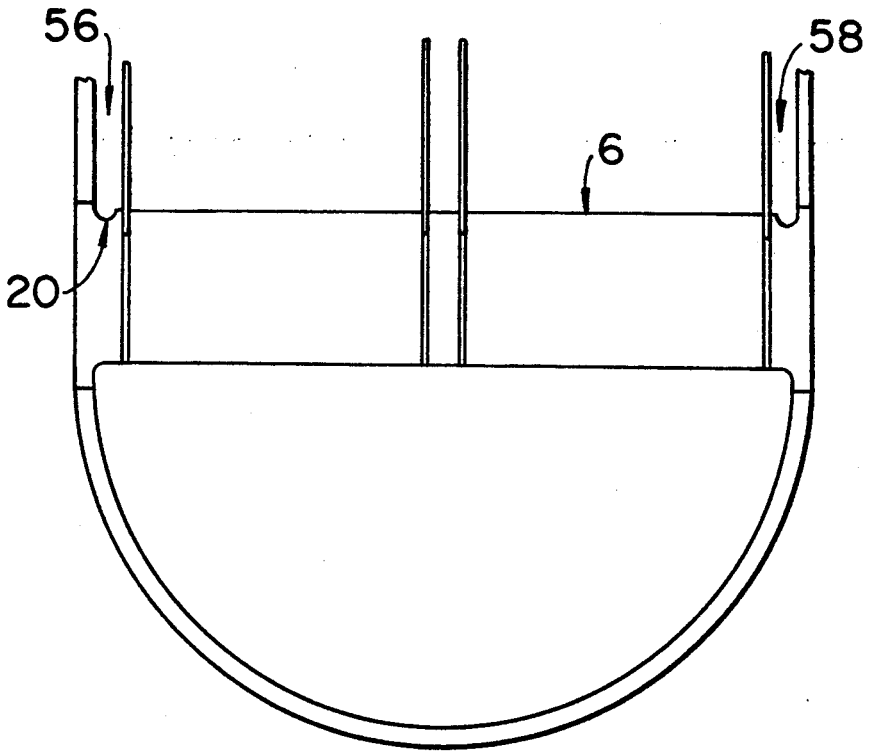
FIG. 3 PRIOR ART
FIG. 3 shows a schematic side view of the tubesheet and annulus portions of a typical nuclear steam generator.
Figure 4:
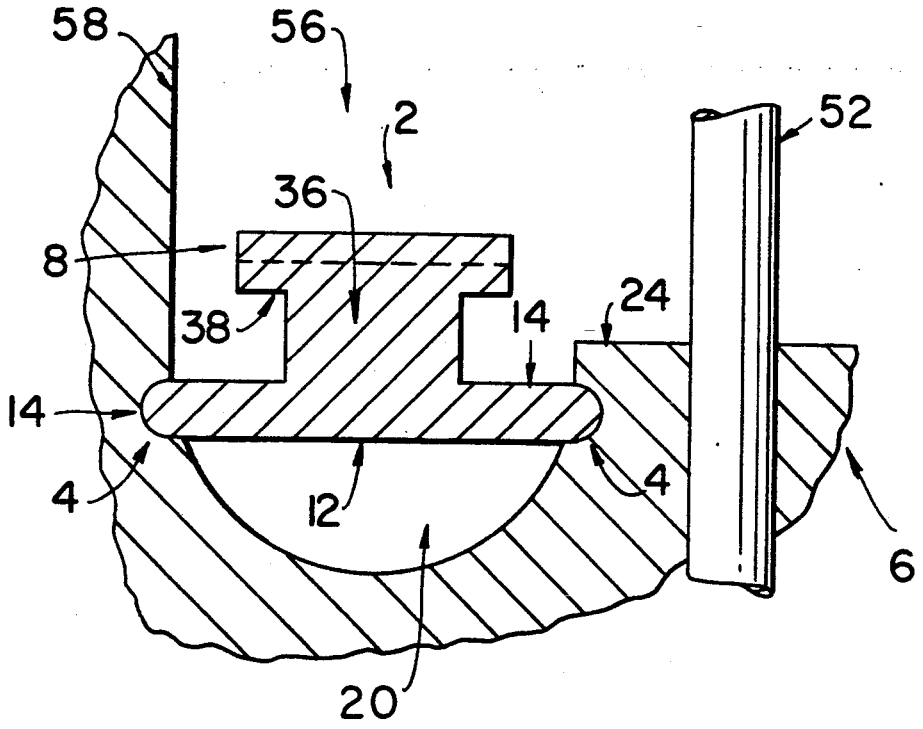
FIG. 4 shows a side view of the segmented track of the present invention in the annulus of a nuclear steam generator.

Toward the bottom of the steam generator, a tubesheet 6 is provided for supporting tube bundles 50. As shown in FIGS. 3 & 4, the tubesheet 6 includes a downwardly curved annulus 20 in the annular space 56 separating tube bundles 50 from steam generator walls 58. Annulus 20 includes a pair of grooves 4 being preferably machined into tubesheet 6, a first inner groove preferably extending toward the center of the steam generator, a second outer groove 4 preferably extending toward the outer wall 58. However, it is readily foreseen that tubesheet 6 may be modified to include support grooves 4 by any conventionally known fashion.

Figure 5:
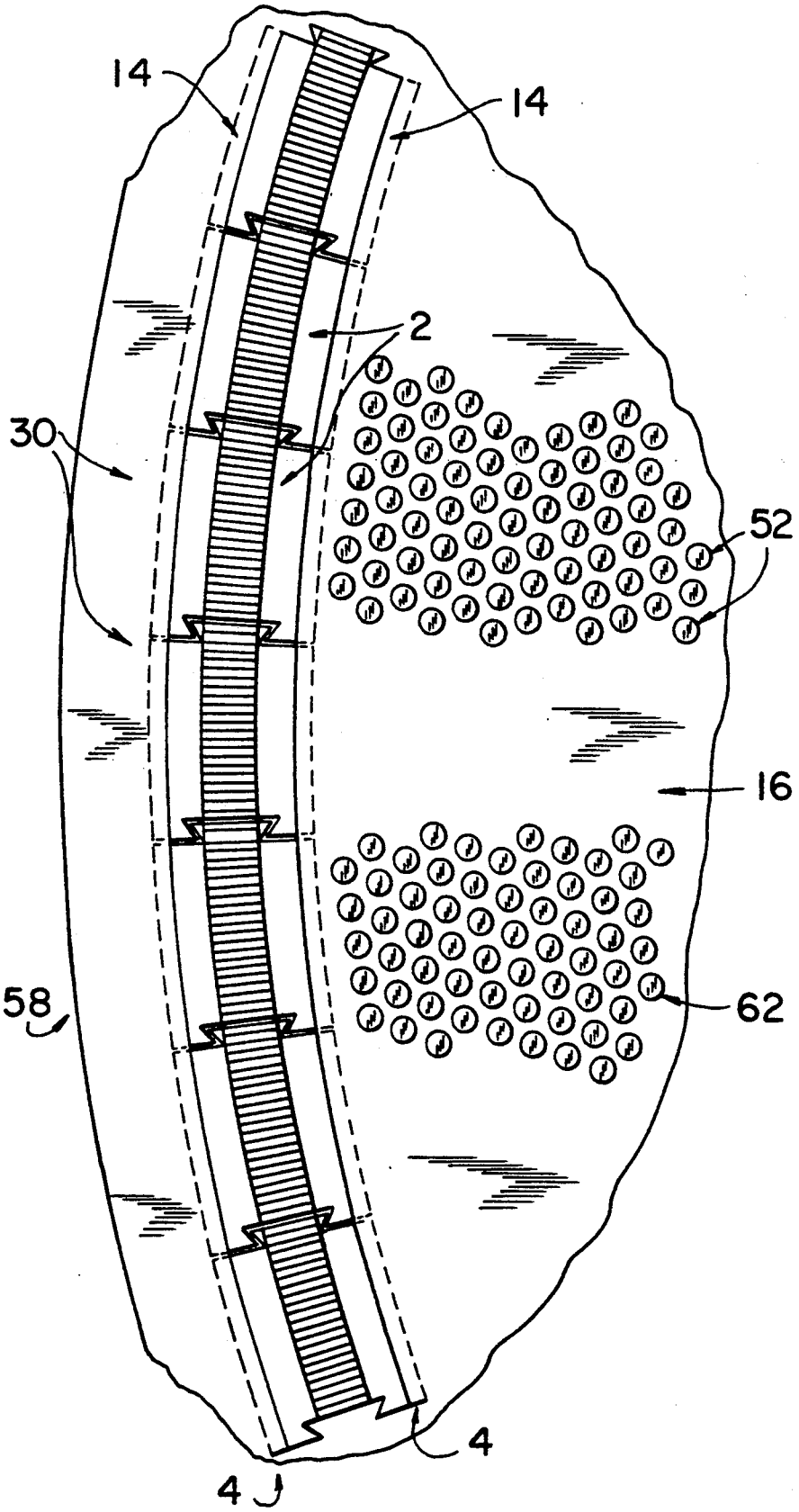
FIG. 5 shows a partial top view of the segmented track of the present invention.
Figure 6:
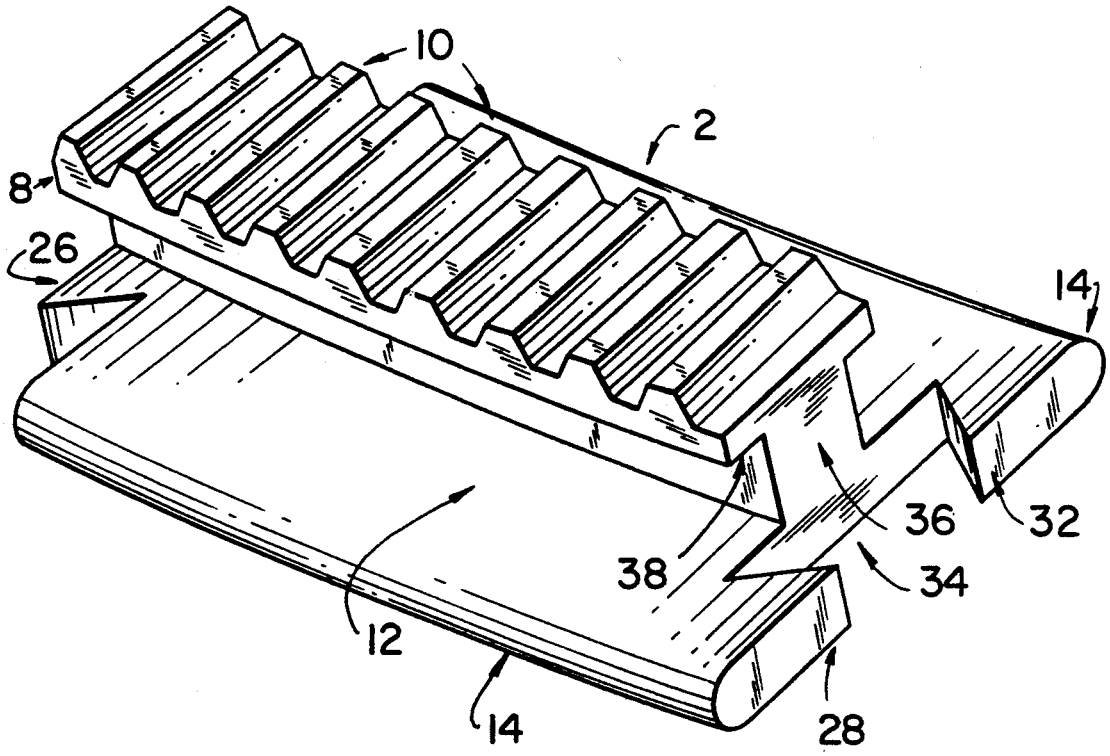
FIG. 6 shows a perspective view of a segment of the track of the present invention.

As shown in FIGS. 4–6, geared segments 2 are provided for being removably inserted in grooves 4 for forming a geared track 30. Each geared segment 2 preferably includes a geared region 8 having gear teeth 10 for providing an accurate means for providing movement of a maintenance apparatus as described hereinafter. In a preferred embodiment, geared region 8 is on the top side of the segment 2. It is readily foreseen that the gear region may be conventionally placed on any exposed region of the segment 2 provided that the gear teeth 10 be accessible from a maintenance apparatus mounted on track 30 having similar gears.

Gear teeth 10 in gear region 8 are preferably of the type which provide stability in hostile environments (i.e., under the forces encountered by a high pressure sludge lancing system), and reduced backlash for accurate position sensing. However, it is readily foreseen that gear teeth 10 may be of any suitable type known in the art.

Each geared segment 2 preferably includes a base 12 having outwardly extending engaging members 14. Members 14 are preferably shaped to mate with and engage grooves 4. Members 14 preferably have a sufficient tolerance so that segments 2 are firmly supported by grooves 4 but are slidable therein. At tubelane 16, the tubesheet lip 24 over the inside groove is preferably machined away for a distance slightly longer than the length of one segment 2 to form a keyway region. The keyway region is preferably located near the steam generator hand hole which would allow an operator to access the keyway. In the keyway region, the ends of the inner groove 4 are exposed, allowing segments 2 to be inserted into the outside groove, and slidably inserted into the inside groove. Once inserted in grooves 4, segments 2 may be slidably moved around the annulus 20, but may not be removed except at the keyway region.

Figure 10:
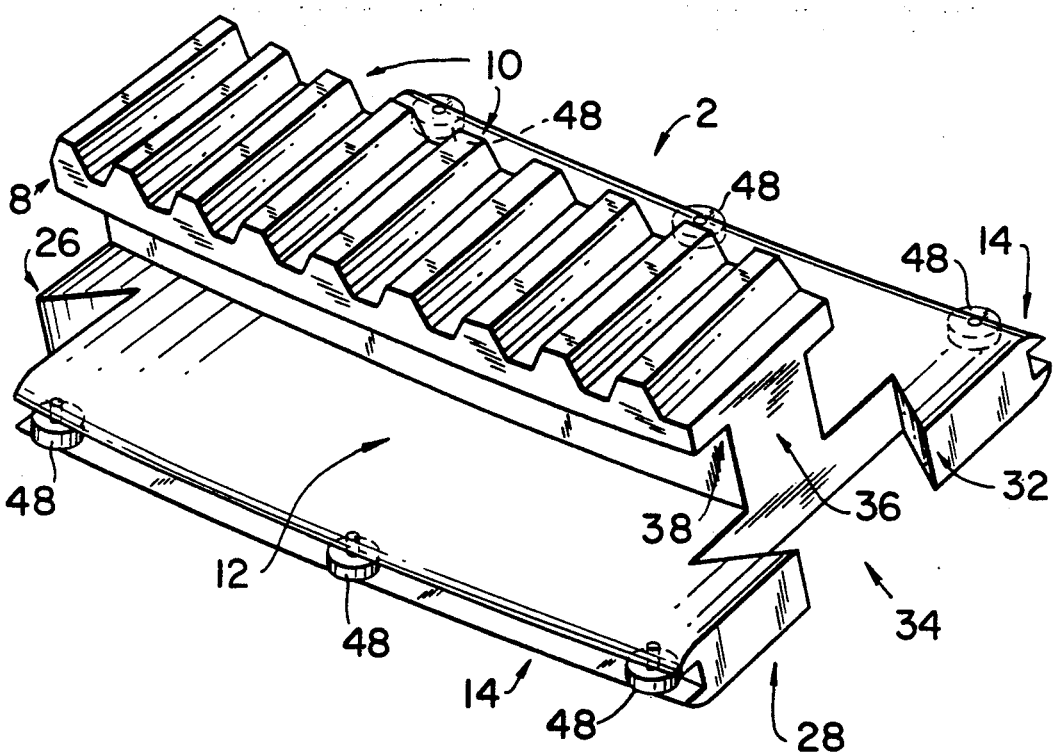
FIG. 10 shows a perspective view of a segment of the track of the present invention, including rollers.

Engaging members 14 are preferably shaped to closely align with grooves 4. However, it is readily foreseen that engaging members 14 may be of any shape suitable for securely engaging grooves 4, as shown in FIG. 10. If desired, rollers or wheels 48 may be mounted to base 12 or engaging members 14 to allow segments 2 to be more easily moved within grooves 4. Particular care must be taken to secure the rollers or wheels to base 12 to prevent parts from detaching and becoming lost in the steam generator.

Each segment 2 is preferably 6–8 inches in length, depending upon the width of the tubelane 16 and the width of the keyway. The keyway width preferably does not exceed the width of the tubelane 16. Since the segments 2 must be inserted in the grooves 4 at the keyway, and the keyway width should not exceed the segment length, the segment lengths are generally limited by the width of the tubelane 16. Each segment 2 is preferably slightly curved so as to be easily insertable into the circular annulus 20 and to form a circular track 30 in the annulus 20.

Segments 2 preferably include an interlocking system to allow a plurality of successive segments 2 to be inserted into the annulus 20 to form track 30, but to be removable without leaving any segments 2 in the annulus 20. Each segment 2 preferably includes a male interlocking member 26, and a female interlocking member 28. As the segments 2 are inserted at the keyway, the male interlocking member 26 of each successive segment 2 is engaged with the female interlocking member 28 of the previously inserted segment 2. These are pushed into the circular annulus 20 in the grooves 4 as succeeding segments 2 are locked onto the previous segments. When all of the segments 2 have been inserted, a continuous firmly engaged circular geared track 30 is present in the annular space 56. The segment 2 located in the keyway region may be secured by conventional securing means, if desired.

As shown in FIG. 6, female interlocking member 28 comprises a pair of inwardly extending lips 32 and a cutaway portion 34. If desired, the sharp edges of lips 32 may be rounded to reduce the likelihood of a fracture forming in the segment. Male interlocking member 26 is sized to securely engage the cutaway portion 34 of female interlocking member 28, so as to be insertable and removable therein.

It is readily foreseen that the segments may be interlocked by other conventionally known techniques. It is preferred that, in use, the interlocking system minimizes the movement of segments 2 to permit accurate position detection along track 30, and the interlocking system should be designed to minimize the risk of parts becoming detached in the steam generator. If desired, segments 2 may be permanently inserted in annulus 20, with no interlocking system.

Base 12 is preferably connected to gear portion 8 by upright member 36 and shoulders 38. Shoulders 38 provide support and stabilization for an apparatus to be mounted to track 30 as hereinafter described. For example, a self-propelled sludge lancing means may be mounted on track 30, being secured to track 30 by attaching means at shoulder 38, and being accurately movable by gear means substantially corresponding to the gears of gear region 8. The sludge lance may include propulsion means, if desired, for driving the sludge lance gearing means and moving the sludge lance relative to track 30.

Segments 2 are preferably constructed of a non-corrosive material capable of operating in the hostile steam generator environment, such as stainless steel or thermoplastic. If the track is to be left in the steam generator during operation, the material must be capable of withstanding the extreme temperature and humidity conditions in the generator. It is readily foreseen that many suitable materials exist from which the segments may be constructed.

Figure 9:
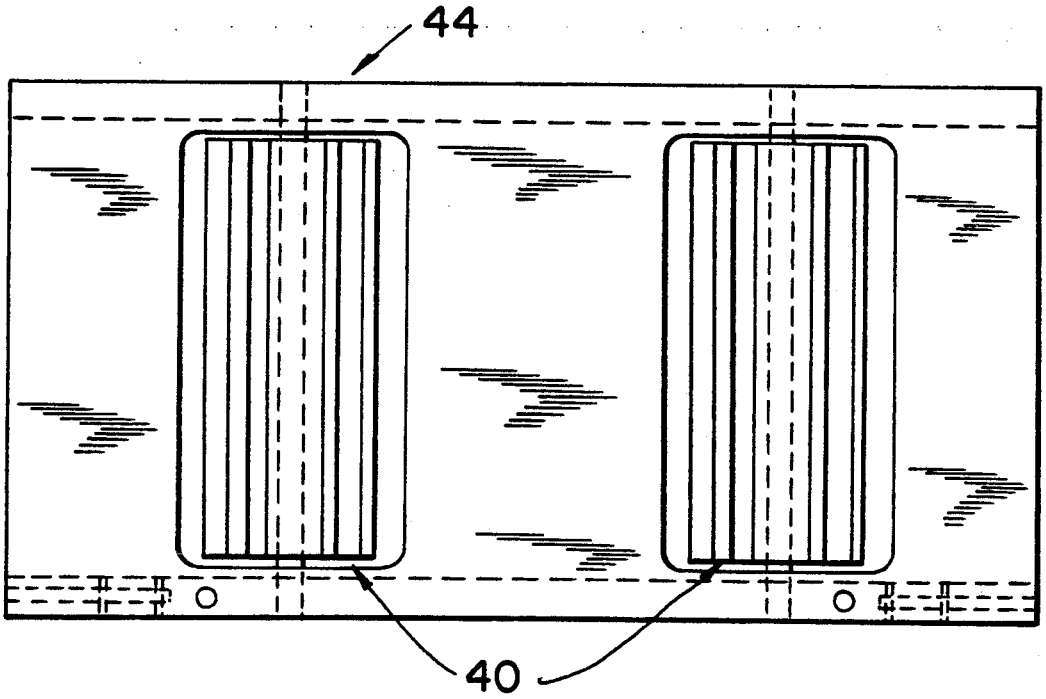
FIG. 9 shows a top view of a support carriage for supporting a maintenance device on the segmented track of the present invention.

The track 30 of the present invention is preferably for use to support a maintenance device for use in the steam generator. As shown in FIGS. 7–9, the maintenance device may be of any type, but preferably includes a support carriage 44 suitable for use with the design of the track 30 as previously described. As previously discussed, the track may have many different cross-sections, having the gears mounted in different positions, having various shoulder configurations, and optionally being removable. The support carriage 44 preferably includes a gear means 40 for meshing with the gear teeth 10 of the track 30 and at least one support arm 42 for grasping the support shoulders 38. If for example, the track 30 includes gear teeth 10 mounted on shoulder 38 instead of on the top of the track, then the support carriage 44 must preferably include a gear drive system compatible with the track.

For example, if the track were of the type as shown in FIG. 6, the support carriage 44 would preferably include stabilizing arms 42 for reaching under the gear region and being supported by shoulders 38. Thus, once mounted on the track 30, the carriage is able to move along the track 30, but may not be removed from the track without either releasing the support arms, 42, i.e. by hinge means 46, or moving the maintenance device to an end of the track 30 (i.e. by removing the segment 2 at the keyway).

The support carriage 44 for riding on track 30 may be attached to any desired maintenance device which may include self-propulsion means for driving the gears on the carriage device. This maintenance device may be, for example, sludge lancing equipment, robotic tube repairing equipment, a device for retrieving lost parts, an inspection camera, etc.

As can be seen from the foregoing, the present invention provides a novel support system for operating many types of maintenance devices in nuclear steam generators. Using the track and carriage combination of the present invention, maintenance equipment may be accurately positioned anywhere around the circumference of the steam generator. Further, the track is stable enough for use even with high power equipment.

Although the present invention has been described in detail with respect to certain embodiments and examples, variations and modifications exist which are within the scope of the present invention as defined in the following claims.

What is claimed is:

1. In an improved steam generator having a plurality of heat exchange tubes supported by a tubesheet and separated by a tubelane, said tubesheet comprising a circular annulus surrounding said heat exchange tubes;

wherein the improvement comprises:

at least a portion of said annulus being machined away, forming thereby a pair of support grooves, each groove having upper and lower lips, an upper lip of one groove being machined away at said tubelane forming a keyway;

track means being removably engaged in said support grooves, said track means comprising a plurality of interlocking segments, each segment having a curvature substantially corresponding to a curvature of said circular annulus and being insertable in said support grooves at said keyway;

each segment comprising extension means for securedly engaging said grooves and being movable therein, interlocking means for allowing a succession of segments to be inserted in said grooves, each segment being releasably attachable to a previously inserted segment, shoulder support means for providing a stabilization point for a steam generator maintenance apparatus, and exposed gear means for providing accurate positioning and movement of said maintenance apparatus relative to said track means;

whereby a removable track may be assembled in an annular space of said steam generator for providing a secure and stable platform for a maintenance device.

2. An improved steam generator according to claim 1 including means for facilitating movement of said segments attached to said extension means for allowing insertion of said segments in said grooves with a reduced friction.

3. An improved steam generator according to claim 2 wherein said means for facilitating movement are selected from the group consisting of wheels and rollers.

4. A support apparatus for a maintenance device in a steam generator having a plurality of heat exchange tubes supported by a tubesheet and separated by a tubelane, said tubesheet comprising a circular annulus surrounding said heat exchange tubes;

which comprises the combination of track means mounted in said annulus, and a support carriage movable on said track means and removably attached thereto, said maintenance device being attachable to said support carriage;

said track means comprising shoulder support means for providing a stable attaching point for said support carriage and exposed gear means;

said support carriage comprising a corresponding gear means for engaging said gear means on said track means for providing accurate positioning and movement of said support carriage relative to said track means, said corresponding gear means being capable of being drivable by a source of power on said maintenance device, and a support arm for demountably engaging said shoulder support means for providing stabilization of said maintenance device;

whereby said support carriage may be removably and securely moved along said track means providing a secure and stable platform for operating a maintenance device in an annular space of said steam generator.

5. A support apparatus for a maintenance device according to claim 4 wherein at least a portion of said annulus is machined away, forming thereby a pair of support grooves, each groove having upper and lower lips, an upper lip of one groove being machined away at said tubelane forming a keyway;

said track means being removably engaged in said support grooves and comprising a plurality of interlocking segments, each segment having a curvature substantially corresponding to a curvature of said circular annulus and being insertable in said support grooves at said keyway;

each segment comprising extension means for securedly engaging said grooves and being slidable therein, interlocking means for allowing a succession of segments to be inserted in said grooves, each segment being releasably attachable to a previously inserted segment;

said track means being removable and assemblable in an annular space of said steam generator for providing a secure and stable platform for said support carriage and said maintenance device.

6. A support apparatus for a maintenance device according to claim 4 wherein said track means are fixedly and nonremovably attached to said annulus.

7. A support track for providing stable mounting of a maintenance device in a steam generator having a plurality of heat exchange tubes being supported by a tubesheet and separated by a tubelane, said tubesheet comprising a circular annulus surrounding said heat exchange tubes; which comprises shoulder support means for providing a stable attaching point for said maintenance device, and exposed gear means for providing an accurate positioning and movement means for said maintenance device relative to said track means, said support track being securely mounted in said annulus;

whereby said track means provides a secure and stable platform for operating a maintenance device in an annular space of said steam generator.

8. A support apparatus for a maintenance device according to claim 7 wherein at least a portion of said annulus being machined away, forming thereby a pair of support grooves, each groove having upper and lower lips, an upper lip of one groove being machined away at said tubelane forming a keyway;

said track means being removably engaged in said support grooves and comprising a plurality of interlocking segments, each segment having a curvature substantially corresponding to a curvature of said circular annulus and being insertable in said support grooves at said keyway;

each segment comprising extension means for securedly engaging said grooves and being movable therein, and interlocking means for allowing a succession of segments to be inserted in said grooves, each segment being releasably attachable to a previously inserted segment;

said track means being removable and assemblable in an annular space of said steam generator for providing a secure and stable platform for said support carriage and said maintenance device.

* * * * *